US006401268B2

(12) United States Patent
Higgins

(10) Patent No.: US 6,401,268 B2
(45) Date of Patent: Jun. 11, 2002

(54) FLUSH VALVE AND FLAPPER, AND METHOD OF ENSURING A GOOD SEAL BETWEEN A VALVE SEAL AND A VALVE SEAT

(76) Inventor: Gary R. Higgins, 33272 Ocean Bright, Dana Point, CA (US) 92629

( * ) Notice: Subject to any disclaimer, the term of this patent is extended or adjusted under 35 U.S.C. 154(b) by 0 days.

(21) Appl. No.: 09/755,421

(22) Filed: Jan. 5, 2001

Related U.S. Application Data

(60) Provisional application No. 60/178,019, filed on Jan. 24, 2000.

(51) Int. Cl.[7] ..... E03D 1/34

(52) U.S. Cl. ..... 4/393

(58) Field of Search ..... 4/392, 393, 403, 4/404

(56) References Cited

U.S. PATENT DOCUMENTS 3,368,224 A * 2/1968 Ament ..... 4/393
4,841,579 A * 6/1989 Antunez ..... 4/393

* cited by examiner

*Primary Examiner*—Charles E. Phillips
(74) *Attorney, Agent, or Firm*—Howard M. Cohn

(57) ABSTRACT

A flapper for a flush valve includes a relatively rigid backing plate and a relatively flexible valve seal. The backing plate includes structure for preventing the seal from being urged into sealing engagement with the backing plate, thereby preventing an air-filled cavity from forming between the seal and the lower surface of the backing plate. The preventing structure may include at least one pair of oppositely spaced ridges extending a first predetermined distance from the lower surface of the backing plate and forming a channel therebetween. The preventing structure may alternately include at least one radially extending channel formed in the backing plate and having a predetermined depth.

16 Claims, 3 Drawing Sheets

FLUSH VALVE AND FLAPPER, AND METHOD OF ENSURING A GOOD SEAL BETWEEN A VALVE SEAL AND A VALVE SEAT

CROSS REFERENCE TO RELATED APPLICATIONS

This application claims the benefit of Provisional Patent Application No. 60/178,019, filed Jan. 24, 2000 by Higgins.

TECHNICAL FIELD OF THE INVENTION

The present invention relates to flapper-type flush valve for toilets, particularly for tank-style, gravity flow toilets and, more particularly, to the effective operation of such flush valves.

BACKGROUND OF THE INVENTION

A typical tank-style, gravity flow toilet comprises a tank and a bowl. The tank stores a quantity of water for flushing the toilet. A flush valve is disposed in the tank. A typical flush valve is a "flapper-type" flush valve, including a rigid backing plate and a flexible valve disposed beneath the backing plate. The valve seal sits atop a discharge pipe in the tank and, when the flush valve is operated, allows the quantity of water stored in the tank to be delivered by gravity flow to the toilet bowl for flushing the toilet.

U.S. Pat. No. 4,841,579, incorporated in its entirety by reference herein, discloses a flapper-type flush valve for toilets. Attention is directed to FIGS. 6–8 therein which illustrate a flush valve comprising a flat, circular, rigid backing plate (50) with a central post portion (53) extending centrally from a bottom surface thereof and a float portion (51) on the top surface thereof. A conical guide portion (52) extends from the post portion (53). The central post portion (53) has a peripheral groove (54) to receive an inner circular edge **(54*a*) of a flat, resilient, disc-like valve seal (55). The valve seal (55) is parallel to and spaced slightly apart from the bottom surface of the backing plate (50). When the valve is closed, the valve seal is forced against the valve seat which is the top end of the discharge pipe. The slight spacing of the inner edge valve seal from the backing plate enables the valve seal to flex, thereby effecting a good seal on the valve seat. However, this flexing (distortion), and resulting non-planarity of the valve seal also results in a cavity (region) being formed between the valve seal and the backing plate since the outer peripheral portion of the valve seal is forced against the planar bottom surface of the backing plate while the inner edge of the valve seal is maintained in spaced relationship from the bottom surface of the backing plate. As disclosed in this patent, this spacing of the valve seal from the backing plate, and resulting cavity (region) formed therebetween "appears somehow to lead to leakage of the valve" (column 4, lines 47–49). It is therefore proposed in this patent to provide one or more vent ports (62)** in the backing plate so as to allow air which is trapped in the region (cavity) between the valve seal and the backing plate to escape, thereby permitting equalization of fluid pressures in the tank and in this region. And further, that "for reasons that are not fully understood, this prevents the valve from leaking as a consequence of valve seal distortion." (column 4, lines 50–57).

SUMMARY OF THE INVENTION

An object of the invention is to provide an improved flapper-type flush valve for toilets, particularly for tank-style, gravity flow toilets.

Another object of the invention is to ensure effective operation of flapper-type flush valves, particularly ensuring a good seal between the valve seal and the valve seat, and more particularly preventing the valve from leaking as a consequence of valve seal distortion.

Applicant proposes that the aforementioned leakage problem discussed in U.S. Pat. No. 4,841,579 arises from the fact that air trapped in a cavity which is formed between the valve seal and the backing plate provides sufficient buoyancy to float the flush valve flapper out of intimate sealing engagement with the flush valve seat. Accordingly, an aspect of the invention is to provide structure for preventing the formation of a cavity between a flush valve backing plate and a flush valve seal. By preventing the formation of the cavity, it is therefore not necessary to vent the cavity, as proposed in the aforementioned U.S. Pat. No. 4,841,579.

According to the invention, at least one channel is formed in a backing plate of a flush valve, on a surface facing the flexible valve seal. The at least one channel preferably extends radially to an outer edge of the backing plate, preferably in a "forward" direction which is opposite a direction of arms extending "rearwardly" from the backing plate for attachment of the flush valve flapper to a standpipe.

According to a feature of the invention, the channels have a depth, and the valve seal is space a distance from the backing plate. The channel depth is one-half of the distance that the valve seal is spaced from the backing plate.

In an embodiment of the invention, the channels may be formed by pairs of ridges, on the surface of the backing plate, wherein each pair of ridges forms a channel, and one of a plurality of channels extends in the "forward" direction.

In an alternate embodiment of the invention, the channels are a plurality of wedge shaped channels extending into the surface of the backing plate, and one of a plurality of channels extends in the "forward" direction.

Other aspects, features and advantages of the invention will become apparent in light of the following description thereof.

BRIEF DESCRIPTION OF THE DRAWINGS

Reference will be made in detail to preferred embodiments of the invention, examples of which may be illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Selected parts of the drawings hereinafter described may be shown out of scale for the sake of illustrative clarity. Moreover, cross-sectional views, if any, that are included herein may be focused on and limited to a view along the line of the cross-section and omit background structure that would otherwise be shown in a true cross-sectional view, again, for the sake of illustrative clarity.

Generally, in the following drawings, like reference numerals, that are either unprimed, primed or double primed, may designate like or corresponding parts throughout the several Figures.

Figure 1:
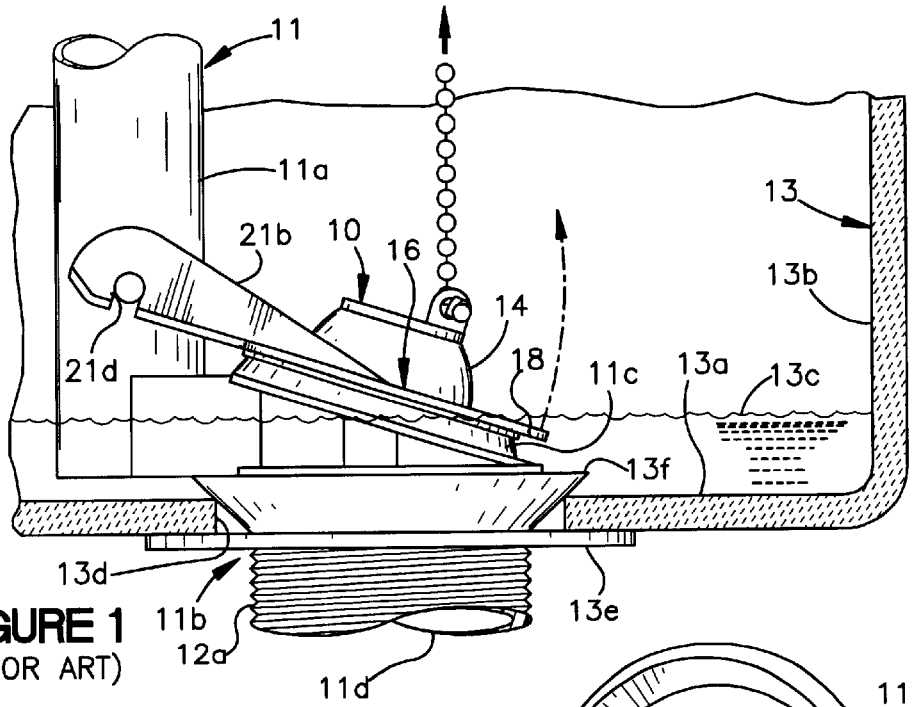
FIGURE 1 (PRIOR ART)
Figure 1A:
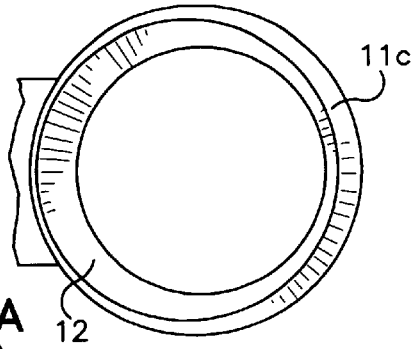
FIGURE 1A (PRIOR ART)
Figure 1B:
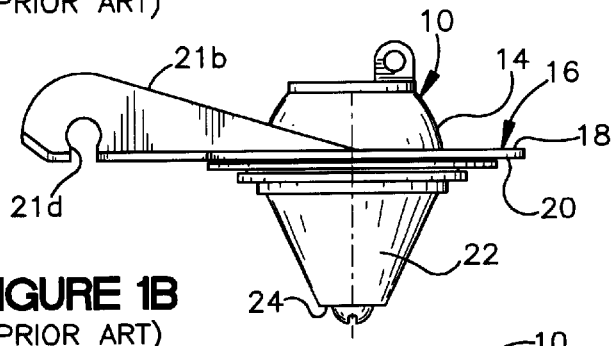
FIGURE 1B (PRIOR ART)
Figure 1C:
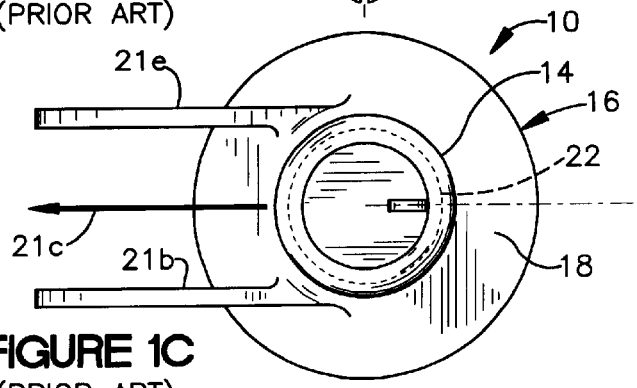
FIGURE 1C (PRIOR ART)
Figure 1D:
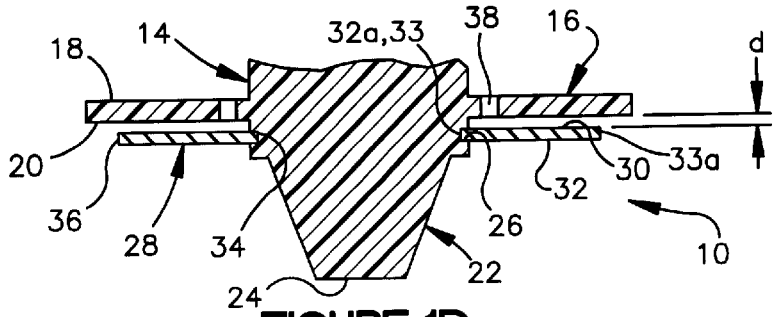
FIGURE 1D (PRIOR ART)
Figure 2:
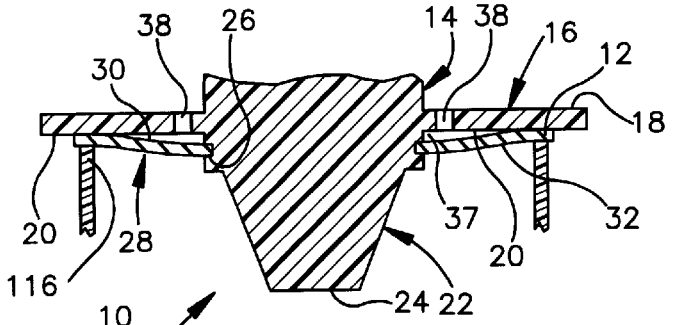
FIGURE 2 (PRIOR ART)
Figure 3:
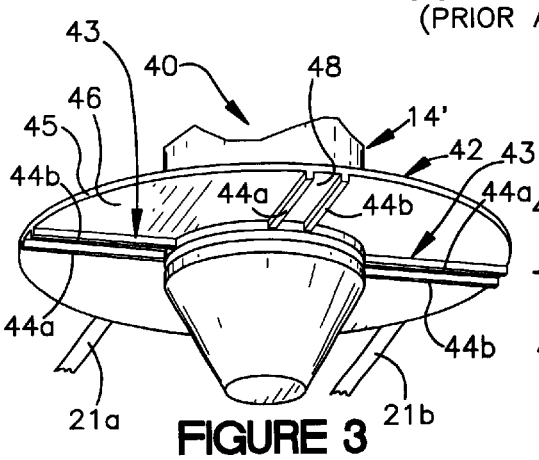
Figure 4:
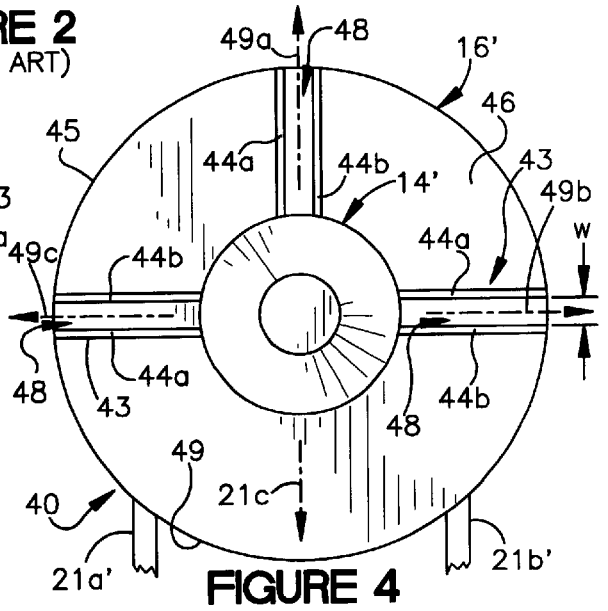
Figure 5:
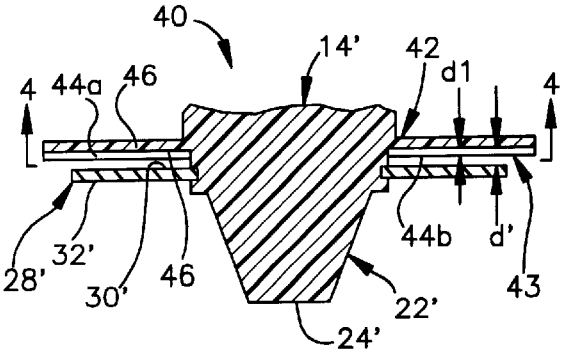
Figure 6:
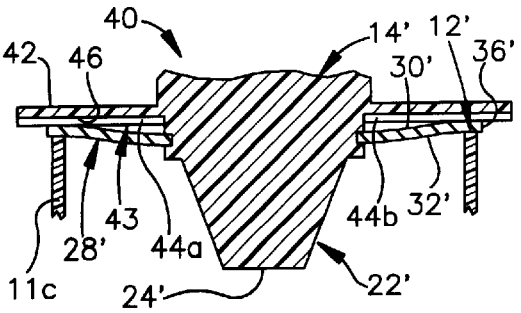
Figure 7:
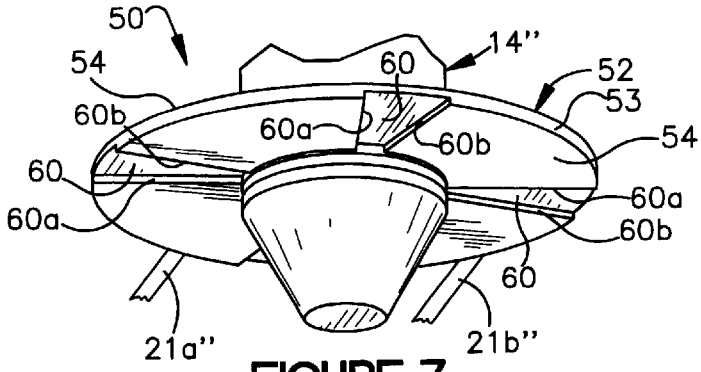
Figure 8:
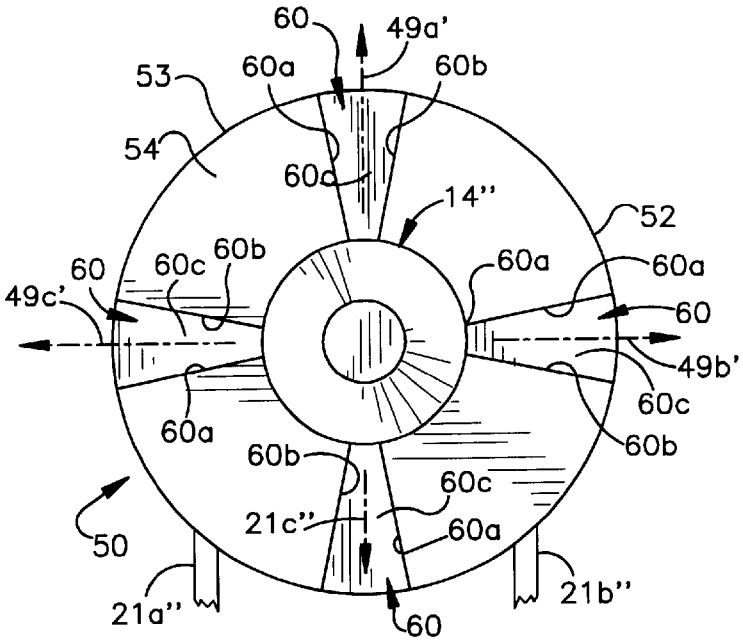
Figure 9:
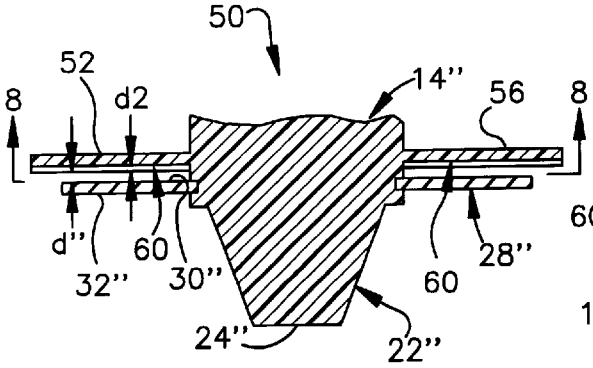
Figure 10:
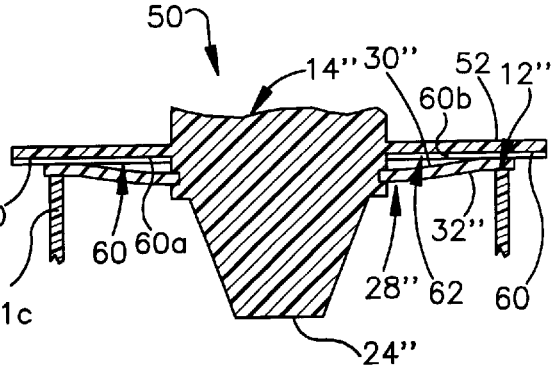

The structure, operation, and advantages of the present preferred embodiment of the invention will become further apparent upon consideration of the following description taken in conjunction with the accompanying figures, wherein:

FIG. 1 is a partial side elevation of a stand pipe assembly including a flush valve connected thereto and seated on a flush valve seat, according to the prior art;

FIG. 1A is a top plan view of the flush valve seat of FIG. 1, according to the prior art;

FIG. 1B is a side view the flush valve flapper of FIG. 1 disconnected from the stand pipe assembly, according to the prior art;

FIG. 1C is a top plan view of the flush valve flapper of FIG. 1B, according to the prior art;

FIG. 1D is a partial vertical section of a portion the flush valve flapper of FIG. 1B, according to the prior art;

FIG. 2 is a view of the portion of the flush valve flapper of FIG. 1D seated on the flush valve seat of FIG. 1A, according to the prior art;

FIG. 3 is a partial perspective view of a flush valve flapper showing the valve seal removed and showing a float-portion backing plate including a plurality of pairs of ridges depending therefrom, according to the invention;

FIG. 4 is a bottom plan view of the flush valve flapper of FIG. 3, taken substantially along the line 4—4 of FIG. 5, according to the invention;

FIG. 5 is a vertical section of the portion of the flush valve flapper shown in FIG. 3, showing the valve seal attached the float portion thereof, according to the invention;

FIG. 6 is a view of the flush valve flapper of FIG. 5 seated on a flush valve seat, according to the invention;

FIG. 7 is a partial perspective view of flush valve flapper according to a preferred embodiment of the invention, showing the valve seal removed and showing a float-portion backing plate including a plurality channels formed therein, according to the invention;

FIG. 8 is a bottom plan view of the flush valve flapper of FIG. 7, taken substantially along the line 8—8 of FIG. 9, according to the invention;

FIG. 9 is a vertical section of the portion of the flush valve flapper shown in FIG. 7, showing the valve seal attached the float portion thereof, according to the invention;

FIG. 10 is a view of the flush valve flapper of FIG. 9 seated on a flush valve seat, according to the invention.

DETAILED DESCRIPTION OF THE INVENTION

FIG. 1 illustrates a prior art construction of flush valve flapper 10 connected in a conventional manner to a standpipe assembly 11 in a toilet tank 13. FIGS. 1A, 1B, 1C, 1D and 2 are more detailed views of various elements shown in FIG. 1.

As best viewed in FIGS. 1 and 1A, the standpipe assembly 11 includes an upright standpipe portion 11*a*, and also includes a depending drainpipe portion 11*b*, having an upper end 11*c* and a lower end 11*d*. The drainpipe portion 11*b* has a conventional flush valve seat 12 at the upper end 11*c* thereof and an externally threaded portion 12*a* at the lower end 11*d* thereof. Preferably, flush valve flapper 10 is suitably removably attached to the stand pipe portion 11*a* for pivotal movement into and out of sealing engagement with the valve seat 12. The stand pipe assembly 11 is suitably mounted in a water tank 13 that includes a base portion 13*a* and an upright wall portion 13*b*, for receiving and containing water 13*c*. To that end, the water tank 13 has an outlet aperture 13*d* formed in the base portion 13*a* thereof, into which the lower end 11*d* of the drainpipe portion 11*b* is inserted and secured in place to the water tank 13 by means of an internally threaded nut 13*e* that is threadably connected to the externally threaded portion 12*a* of the drain pipe portion 11*b* so as to urge a waterproof gasket 13*f* mounted thereabout into sealing engagement with the water tank base portion 13*a*.

As best viewed in FIGS. 1B and 1C, the flush valve flapper 10 generally includes a centrally located, domed, circularly shaped, float portion 14, having a backing plate 16 that radially extends outwardly therefrom. The backing plate 16 has an outer, or tank-water, side 18 and an inner side 20. In addition, the flapper 10 includes a pair of elongate, oppositely spaced, arm portions 21*a* and 21*b*, extending in a given direction, as shown by the arrow 21*c*, substantially parallel, to one another from the outer, or tank water, side 18 of the backing plate 16. The arm portions, 21*a* and 21*b*, respectively include a conventional slot 21*d* formed therein, for removable attachment of the flush valve flapper 10 (FIG. 1) to the standpipe portion 11*a*.

As best viewed in FIGS. 1B and 1C, the flapper 10 includes a centrally located, substantially conically shaped, seat guide portion 22. The conically shaped portion 22 depends from the float portion 14 and has a lower end 24.

As best viewed in FIG. 1D, the flush valve flapper 10 includes a circumferentially extending groove 26, which is formed in the float portion 14, a selected distance "d" beneath the backing plate 16. Further, the flapper 10 includes a removably mounted, flexible, disc-shaped valve seal 28 having an inner side 30 and an outer, or drainpipe, side 32. The valve seal 28 has an inner circularly extending edge 32*a* that defines a central aperture 33 thereof and has an outer circularly extending edge 33*a*. The valve seal 28 is sufficiently flexible to permit coaxially inserting the lower end 24 of the conically shaped guide portion 22 into the valve seal aperture 33, moving the valve seal 28 upwardly around the guide portion 22 and inserting the inner edge 32*a* of the valve seal 28 into the groove 26. As thus constructed and arranged, the disc-shaped valve seal 28 is connected to the float portion 14 so as to radially extend outwardly therefrom.

Referring to FIG. 2, when the flapper 10 is seated on the flush valve seat 12, the outer, drainpipe, side 32 of the valve seal 28 is peripherally urged into sealing engagement with the flush valve seat 12 for closing off the flow of water 13*c* (FIG. 1) from the water tank 13. In addition, the inner, water tank, side 30 (FIG. 2) of the disc-shaped valve seal 28 is peripherally urged into sealing engagement with the inner side 20 of the backing plate 16 and forms therewith an annularly-extending cavity 37.

A more detailed description of the prior art subject matter discussed hereinabove with reference to FIGS. 1, 1A, 1B, 1C, 1D and 2 may be found in the aforementioned U.S. Pat. No. 4,841,579. As discussed in that patent, "for reasons that are not fully understood", but which are attributable to the existence of the cavity 37, leakage "eventually" occurs between the valve seat 12 and the valve seal 28. And, providing one or more vent ports 38 in the backing plate 16 to equalize the tank water pressure gradient across the backing plate 10 purportedly cures such tendency for leakage.

Notwithstanding the proposals of U.S. Pat. No. 4,841,579, Applicant believes that the valve leakage is more properly attributable to air which is trapped in the cavity 37 (see FIG. 2) providing sufficient buoyancy to the flush valve flapper 10 to gradually lift the disc-shaped valve seal 28 (see FIG. 1 and 1A) out of intimate sealing engagement with the flush valve seat 12. Moreover, Applicant notes that the prior art vent ports 38 (see FIGS. 1D and 2) do not "prevent" the formation of the cavity 37, since they extend through the backing plate 16 from the outer, water tank, side 18 thereof to the inner side 20 thereof. Thus, when the water tank 13 is flushed, the vent ports 38 allow the tank water pressure gradient across the backing plate 16 to be equalized after the flapper 10 is seated on the valve seat 12, and when the backing plate 16 is partially immersed in the water 13*c* (FIG. 1) flowing into the water tank 13. Moreover, it is noted that, if the flow of water 13*c* into the water tank 13 is sufficiently rapid, the vent ports 38 may well not allow water to flow therethrough quickly enough to prevent the buoyancy of the flush valve flapper 10 from raising the valve seal 28 out of sealing engagement with the flush valve seat 12.

To remedy this potential problem, Applicant has provided an improvement in the prior art flush valve flapper 10, including structure for preventing the disc-shaped valve seal 28 from being urged into sealing engagement with the backing plate 16 when the valve seal 28 is seated on the flush valve seat 12 and the backing plate 16 is urged downward by water pressure, thereby preventing the formation of the cavity 37.

Providing Ridges On The Backing Plate

FIGS. 3–6 illustrate an embodiment of a flush valve flapper 40 which is similar to the prior art flush valve flapper 10 of FIG. 1. However, unlike the backing plate 16 of the prior art, there are no apertures 38 formed therein. Rather, the flush valve flapper 40 (FIGS. 3–6) includes a generally circular, substantially rigid backing plate 42 that has at least one and preferably a plurality of pairs 43 of elongate, radially extending, ridges, 44*a* and 44*b*. Each of the ridges of a given pair 43 of ridges is laterally spaced apart from the other ridge, and generally parallel thereto. And, each of the ridges, 44*a* and 44*b*, extends (depends) a distance (has a height) "d1" from the inner side (surface) 46 of the backing plate 42 toward an inner side (surface) 30' of the flexible valve seal 28', thereby forming with the inner side 46 of the backing plate 42 an elongate channel 48 that radially extends between the backing plate outer edge 49 and the seat guide portion 22'.

As in the prior art, the flush valve flapper 40 includes a pair of arms, 21*a*' and 21*b*', extending in a given direction 21*c* from the outer side (surface) 42 of the backing plate 42. For the purpose of this disclosure the "given" direction 21*c* is the direction that extends "rearward" or "rearwardly" of the float portion 14', and a direction that extends substantially (approximately) 180 degrees opposite thereto, as shown by the arrow 49*a*, is the direction that extends "forward" or "forwardly" of the float portion 14'. Moreover, the opposite directions that respectively extend opposite to one another and substantially (approximately) at right angles to the both the rearward and forward directions, 21*c*' and 49*a*, as shown by the arrows, 49*b* and 49*c*, are each directions that extend opposite to one another and "laterally" from the float portion 14'.

If there is only one channel 48 provided on the backing plate, it is preferred that the one channel is disposed so as to extend in the forward direction 49*a*. If there are a plurality of channels 48 provided on the backing plate, it is preferred that one of the channels 48 extends in the forward direction 49*a*, another of the channels 48 extends in the lateral direction 49*b* and yet another of the channels 48 extends in the lateral direction 49*c*. The channels preferably extend to an outer edge 45 of the backing plate 42.

The valve seal 28' is offset from the backing plate 42 by a distance "d'". Preferably, the distance d1 (the height of the ridges) is substantially (approximately) equal to one-half of the distance d' between the backing plate 42 and the valve seal 28'. Moreover, it has been experimentally determined to be preferable to provide three channels 48, each having a width "w", as measured between the adjacent ridges, 44*a* and 44*b*, thereof, of not less than substantially (approximately) one (1) millimeter. As thus constructed and arranged, when the flush valve flapper 40 is seated on the flush valve seat 12', the outer side 32' of the disc-shaped valve seal 28' is still peripherally urged into sealing engagement with the flush valve seat 12', but the inner side 30' of the disc shaped valve seal 28' is prevented from sealingly engaging the inner side 46 of the backing plate 42 and, therefore, does not form a cavity 37 (see FIG. 2) therebetween. Rather, the seated seal 28' (FIG. 6) and the backing plate 42 are spaced apart from one another by the radially extending elongate ridges, 44*a* and 44*b*, forming the respective channels 48. And the channels 48 provide respective passageways for the flow of water 13*c* between the seal 28' and backing plate 42. In this embodiment of the invention, the preferred channel width w has been found to be more than sufficient to permit all of the water flow that my be needed beneath the inner surface 46 of the backing plate 42, to avoid even a possibility of the float portion 16' providing sufficient buoyancy to the flush valve flapper 40 to raise the flush valve seal 28' out of sealing engagement with the flush valve seat 12' before the float portion 16' is completely submerged in tank water 13*c* (FIG. 1).

In summary, the backing plate 42 has a surface 46 facing a surface 30' of the valve seal 28'. The valve seal is spaced a distance d' from the backing plate. Ridges 44*a* and 44*b* are disposed on the surface 46 of the backing plate 42, and preferably extend radially from an inner (e.g., central) position on the backing plate to the periphery (an outer edge 45) thereof. The ridges 44*a* and 44*b* are preferably arranged in pairs, and a pair of ridges forms a channel 48. The ridges have a height d1, which is preferably one half the distance d' (d1=d'/2). The two ridges of a pair of ridges are preferably parallel with one another and are preferably spaced at least one millimeter apart from one another. Preferably, at least one pair of ridges is disposed to form a channel in the forward direction 49*a* of the backing plate. Subsequent two pairs of ridges are preferably disposed in the lateral directions 49*b* and 49*c*. The ridges substantially prevent the formation of a cavity trapping air and causing buoyancy between the valve seal and the backing plate, thereby obviating the need for vents (38) through the backing plate and improving the overall effectiveness of the flush valve.

It is within the scope of the invention that the ridges 44*a*, 44*b* are provided on the surface 30' of the valve seal 28' rather than on the surface 46 of the backing plate 42.

It is within the scope of the invention that the ridges 44*a*, 44*b* are not arranged in pairs, and that selected ones of the ridges are not continuous from the inner portion of the backing plate to the periphery thereof.

It is within the scope of the invention that a plurality of raised "dots", rather than ridges, are provided on the surface 46 of the backing plate 42, or alternatively on the surface 30' of the valve seal 28'.

Furthermore, as set forth in the following description of an alternate embodiment of the invention, rather than ridges, grooves or channels can be formed in the seal-facing surface of the backing plate (alternatively, in the backing plate facing surface of the valve seal) to prevent cavity formation.

Alternate Embodiment

FIGS. 7–10 illustrate another embodiment of the invention—a flush valve flapper 50, which is also similar to the prior art flush valve flapper 10 (FIGS. 1 and 1A). However, unlike the backing plate 16 of the prior art, there are no apertures 38 (FIGS. 1D and 2) formed therein. Rather, the flush valve flapper 50 includes a generally circular, substantially rigid backing plate 52 having an outer edge 53. In addition the backing plate 52 includes an outer side 54 and includes an inner side (surface) 56 having a plurality of elongate, radially extending, grooves or channels 60 formed therein. Each of the channels 60 includes a pair of laterally spaced, radially extending sidewalls, 60*a* and 60*b*, and a base wall 60*c*. The respective sidewalls, 60*a* and 60*b*, preferably converge toward one another as they extend from the backing plate outer edge 53 to the float portion 14". As in the prior art, the flush valve flapper 50 includes a pair of arms 21*a*' and 21*b*' extending in a given direction 21*c* from the outer side 52 of the backing plate 52. And, as noted above, for the purpose of this disclosure the "given" direction 21*c*' is the direction that extends "rearward" or "rearwardly" of the float portion 14", and a direction that extends substantially (approximately) 180 degrees opposite thereto, as shown by the arrow 49*a*', is the direction that extends "forward" or "forwardly" of the float portion 14". Moreover, as noted above the opposite directions that respectively extend opposite to one another and substantially (approximately) at right angles to the both the rearward and forward directions, 21*c*' and 49*a*, as shown by the arrows, 49*b*' and 49*c*', are each directions that extend opposite to one another and "laterally" from the float portion 14". Assuming the provision of one channel 60, the one channel 60 preferably extends in the forward direction 49*a*'. And, assuming the provision of a plurality of channels 60, one of the channels 60 extends in the forward direction 49*a*', another of the channels 60 extends in the lateral direction 49*b*', yet another of the channels 60 extends in the lateral direction 49*c*', and a further channel 60 extend in the rearward direction 21*c*"

Preferably, each of the channel side walls, 60*a* and 60*b*, laterally extends a distance (has a depth) "d2" from the inner side 54 of the backing plate 60 to the channel base wall 60*c* and forms therewith an elongate, substantially wedge-shaped, channel 60 in the backing plate 50. And, the channel 60 radially extends between the backing plate outer edge 53 and the float portion 14". Preferably, the distance d2 is substantially (approximately) equal to one-half of the distance d" between the backing plate 50 and the valve seal 28". Moreover, it has been experimentally found preferable to provide four channels 60, each having an arcuately extending width "w1" as measured at the outer end thereof along the backing plate outer edge 53, of twice the arcuately extending width "w2" thereof as measured at the inner end thereof along the float portion, wherein the width w2 is substantially (approximately) two (2) millimeters. As thus constructed and arranged, when the flush valve flapper 50 is seated on the flush valve seat 12", the outer side 32" of the disc-shaped valve seal 28" is still peripherally urged into sealing engagement with the flush valve seat 12". However, the inner side 30" of the disc shaped valve seal 28" is not peripherally urged into "sealing" engagement with the inner side 54 of the backing plate 52. Rather, the seated seal 28' (FIG. 6) and the backing plate 42 are spaced apart from one another by the radially extending elongate channels 60 formed in the backing plate 52. And the channels 60 provide respective passageways for the flow of water 13*c* (FIG. 1) between the seal 28*a*" and backing plate 52. In this embodiment of the invention, the preferred channel width dimensions, w1 and w2, have been found to be more than sufficient to permit all of the water flow that may be needed beneath the inner surface 54 of the backing plate 52, to avoid even a possibility of the float portion 16" providing sufficient buoyancy to the flush valve flapper 50 to raise the flush valve seal 28" out of sealing engagement with the flush valve seat 12" before the float portion 16" is completely submerged in tank water 13*c* (FIG. 1)

As thus constructed and arranged, when the flapper 50 is seated on the flush valve seat 12", the periphery of the disc-shaped seal 28" may still be urged into sealing engagement with the flush valve seat 12". On the other hand, the inner side 54 of the backing plate 52 is not urged into sealing engagement with the inner side 30" of the disc-shaped seal 28" and does not form therewith the air-trapping, buoyancy-causing cavity 38 of the prior art (FIGS. 1D and 2). Rather, as thus constructed and arranged, the seated seal 28" (FIG. 10) and backing plate 52 together form a least one and preferably a plurality of channels 60 that radially extend inwardly thereof to permit the free flow of water 13*c* beneath the backing plate.

It is within the scope of the invention that ridge elements, similar to the embodiments shown in FIGS. 3–6 or grooves similar to the grooves shown in the embodiment of FIGS. 7–10, may be provided on the disc-shaped seal 28 of the flapper valves, 40 and 50, to prevent the valve seal from being urged into sealing engagement with the associated backing plate and thereby preventing the formation of a cavity forming an air pocket between the valve seal 28 and the corresponding backing plate.

The invention has been illustrated and described in a manner that should be considered as exemplary rather than restrictive in character—it being understood that only preferred embodiments have been shown and described, and that all changes and modifications that come within the spirit of the invention are desired to be protected. Undoubtedly, many other "variations" on the techniques set forth hereinabove will occur to one having ordinary skill in the art to which the present invention most nearly pertains, and such variations are intended to be within the scope of the invention, as disclosed herein.

What is claimed is:

1. Flush valve flapper comprising:

a generally circular, substantially rigid backing plate having a surface; and at least one channel formed in the surface of the backing plate, the at least one channel extends to an outer edge of the backing plate; and a flexible valve seal spaced a distance from the backing plate; wherein:

the at least one channel has a depth; and the depth is substantially one-half of the distance.

2. A flush valve flapper, according to claim 1, further comprising:

a pair of oppositely spaced arms extending from the backing plate in a rearward direction;

wherein a selected one of the at least one channels extends in a forward direction.

3. Flush valve for a toilet, comprising:

a relatively rigid backing plate having a seal-facing surface;

a relatively flexible valve seal having a backing plate-facing surface facing the seal-facing surface of the backing plate;

means for providing for the flow of water between the valve seal and the backing plate; and the means for providing flow is at least one channel on the seal-facing surface of the backing plate.

4. A flush valve, according to claim 3, wherein:

the at least one channel is substantially wedge-shaped.

5. A flush valve, according to claim 3, wherein:

the at least one channel is formed by at least one sidewall extending to a depth into the seal-facing surface of the backing plate.

6. A flush valve, according to claim 5, wherein:

the valve seat is spaced a distance from the backing plate; and the depth is approximately one half the distance.

7. A flush valve, according to claim 6, wherein:

the at least one channel extends to an outer edge of the seal-facing surface.

8. A flush valve, according to claim 6, wherein:

the at least one channel extends in a forward direction along the seal-facing surface.

9. A flush valve, according to claim 6, wherein:

the at least one channel is formed by at least one ridge having a height.

10. A flush valve, according to claim 9, wherein:

the valve seat is spaced a distance from the backing plate; and the height is approximately one half the distance.

11. A flush valve, according to claim 6, wherein:

the at least one channel is formed by a pair of ridges; and the ridges are spaced not less than approximately one millimeter apart from one another.

12. Method of ensuring a good seal between a valve seal of a flapper-type flush valve and a valve seat of a discharge pipe of a tank-style toilet, the valve seal being relatively flexible and having a backing plate-facing surface, the flush valve having a relatively rigid backing plate with a valve-seal facing surface, the valve seal being spaced a distance from the backing plate, the method comprising:

preventing formation of an air-trapping, buoyancy-causing cavity between the valve seal and the backing plate; and the formation of the cavity is prevented by providing at least one channel on at least one of the seal-facing surface of the backing plate and the backing-plate surface of the valve seal.

13. Method, according to claim 12, wherein:

the at least one channel extends to an outer edge of the surface.

14. Method, according to claim 12, wherein:

the at least one channel extends in a forward direction along the surface.

15. Method, according to claim 12, wherein:

the at least one channel is formed by at least one ridge having a height which is approximately one half a distance that the valve seat is space from the backing plate.

16. Method, according to claim 12, wherein:

the at least one channel is formed by at least one sidewall having a depth which is approximately one half a distance that the valve seat is space from the backing plate.

* * * * *